US005813667A

United States Patent [19]

Imai et al.

[11] Patent Number: 5,813,667

[45] Date of Patent: Sep. 29, 1998

[54] SHEET DELIVERY DEVICE

[75] Inventors: Tsuneo Imai, Ebina; Akiko Shibuya, Sagamihara, both of Japan

[73] Assignee: Hitachi, Ltd., Tokyo, Japan

[21] Appl. No.: 757,940

[22] Filed: Nov. 27, 1996

[30] Foreign Application Priority Data

Nov. 30, 1995 [JP] Japan ..... 7-312496

[51] Int. Cl.[6] ..... B65H 39/02

[52] U.S. Cl. ..... 270/58.14; 270/58.19; 270/58.32

[58] Field of Search ..... 270/58.01, 58.07, 270/58.14, 58.18, 58.19, 58.31, 58.32

[56] References Cited

U.S. PATENT DOCUMENTS 2,619,883 12/1952 Andren ..... 270/58.32
4,983,096 1/1991 Bodewein ..... 270/58.32 X
5,382,012 1/1995 Mandel et al. ..... 270/58.14
5,407,081 4/1995 Oshino et al. ..... 270/58.31 X

*Primary Examiner*—Hoang Nguyen
*Attorney, Agent, or Firm*—Antonelli, Terry, Stout & Kraus, LLP

[57] ABSTRACT

A sheet delivery device having a plurality of delivery trays, a printed sheet detector for detecting whether residual printed sheets are present in a delivery tray other than a selected delivery tray, a full storage detector for detecting a full storage state of the selected delivery tray, a sheet delivery unit for delivery sheets to the selected delivery tray and a control unit for controlling the sheet delivery unit. When the printed sheet detector detects residual printed sheets in the next delivery tray other than the selected delivery tray and when the destination of the printed sheet is changed from the selected delivery tray to the other delivery tray, the sheet delivery unit delivers printed sheets to the other delivery tray in a manner so that the printed sheets can be discriminated from the residual sheets.

44 Claims, 4 Drawing Sheets

FIG. 3A
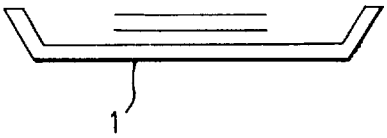
FIG. 3B
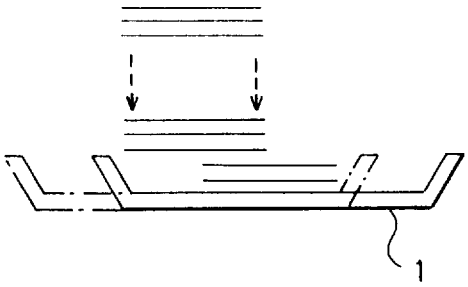
FIG. 4A
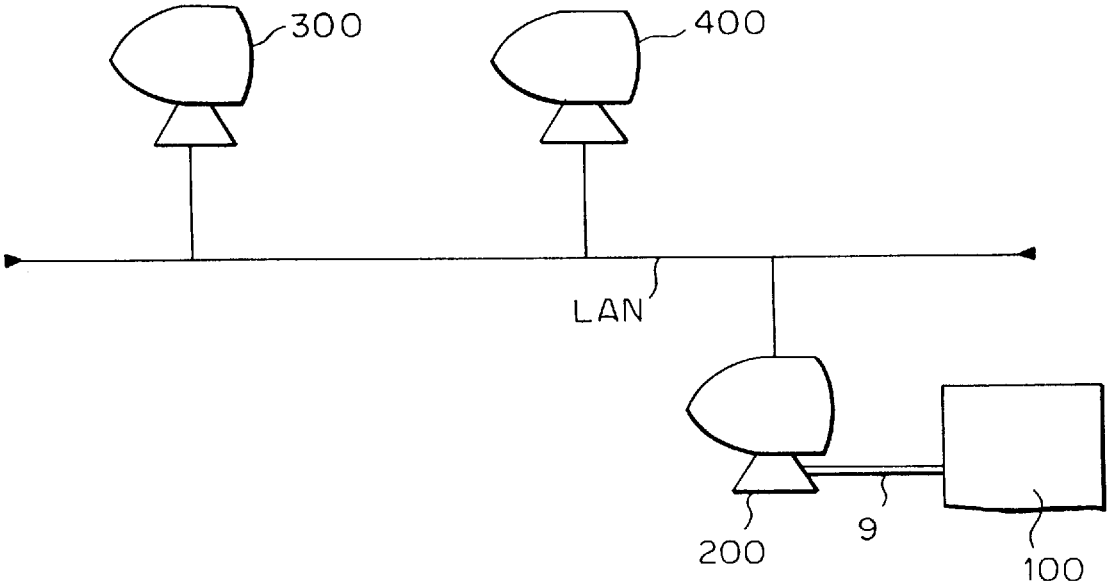
FIG. 4B
| PRINT DATA (DOCUMENT) | CONTROL DATA |
|---|---|

SHEET DELIVERY DEVICE

BACKGROUND OF THE INVENTION

The present invention relates to a sheet delivery device having a plurality of delivery trays, and delivery apparatus for delivering sheets to a selected delivery tray among a plurality of delivery trays. More particularly, the present invention relates to a sheet delivery method, apparatus and computer program to be employed in printers and copying machines that delivers sheets to a selected delivery tray so that the sheets can be discriminated from residual sheets that may be present in the selected delivery tray.

Printers of various types, which are essential peripheral apparatuses for computers, meeting the needs of various types of users have been marketed. Some printers are provided with a plurality of delivery trays for storing sheets, specified by, recording sheets carrying information provided by a computer or the like. Such a printer is provided with delivery apparatus for delivering sheets to a selected delivery tray. The combination of the delivery apparatus and the plurality of delivery trays will be designated as a sheet delivery device.

The operation of a printer provided with such a sheet delivery device will be described hereinafter on an assumption that the sheet delivery device is provided with two delivery trays A and B for the sake of simplicity.

Suppose that a user A uses the printer and the printer delivers sheets to the delivery tray A. No problem arises when the number of sheets to be delivered to the delivery tray A is less than the storage capacity of the delivery tray A. However, in some cases, the number of sheets to be delivered to the delivery tray A exceeds the storage capacity of the delivery tray A.

Conventional printers are designed to be able to detect automatically that the delivery tray A is fully loaded with sheets to its maximum storage capacity. When the delivery tray A is fully loaded with sheets, the delivery tray B is selected automatically and the subsequent sheets are delivered to the delivery tray B. The delivery tray A is emptied while sheets are being delivered to the delivery tray B, and sheets are delivered again to the delivery tray A after the delivery tray B has fully been loaded with sheets.

However, if residual sheets which were previously stored in the delivery tray B for another user B remain in the delivery tray B when the delivery tray A is fully loaded and the delivery tray B is selected automatically, sheets for the user A delivered to the delivery tray B are stacked on the residual sheets for the user B. Naturally, if residual sheets for the user B exist in the delivery tray A, the sheets for the user A are stacked on the residual sheets for the user B. When both the sheets for the user A and those for the user B are stacked in the delivery tray A or B, the users A and B need to identify the sheets for them by the printed contents and to sort the sheets. Performing such operations by the user is time consuming and tedious. Such a problem arises very often at offices due to various causes, for instance when the user B who used the printer before the user A left the sheets for the user B on the printer or the user B has not yet taken out the sheets for the user B.

Some conventional printers are designed to stop delivering sheets to a selected delivery tray if there are residual sheets in the selected delivery tray.

However, this conventional printer stops delivering sheets to the selected delivery tray even if the delivery tray is not fully loaded (in an extreme case, when even a single sheet remains in the delivery tray). Such a sheet delivering mode reduces the throughput of the printer greatly.

SUMMARY OF THE INVENTION

It is an object of the present invention to provide a sheet delivery device, a sheet delivery method and a sheet delivery computer program capable of sorting out residual sheets remaining in a delivery tray and sheets stacked on the residual sheets and of delivering sheets at a high throughput.

According to a first aspect of the present invention, a sheet delivery device is provided having a plurality of delivery trays, a delivery apparatus for delivering sheets to a selected delivery tray among the plurality of delivery trays, a selector for selecting a delivery tray to which sheets are to be delivered among the plurality of delivery trays, and a sheet detector for detecting whether or not any residual sheets exist in the delivery tray selected by the selector. The delivery apparatus delivers sheets so that the sheets can be discriminated from the residual sheets when the sheet detector detects the residual sheets in the selected delivery tray.

According to a second aspect of the present invention, the sheet delivery device according to the first aspect of the present invention further includes a sheet quantity detector for detecting whether or not a predetermined quantity of sheets is contained in the delivery tray selected by the selector, and the selector selects a delivery tray other than the delivery tray containing the predetermined quantity of sheets detected by the sheet detector.

A third aspect of the present invention is a sheet delivery method which delivers sheets to a selected delivery tray so that the delivered sheets can be discriminated from residual sheets that may be present in the selected delivery tray. The steps of the method can be performed by a control unit.

A fourth aspect of the present invention is a sheet delivering computer program which can be installed as part of the control unit or provided on a storage medium such as a floppy disk or compact disk (CD) for installation and execution by a control unit. The computer program can also be distributed to the control unit from a storage medium by a server via a network. The computer program distributed to the control unit upon being executed by the control unit causes sheets to be delivered to a selected tray in such a manner that the delivered sheets can be discriminated from residual sheets that may be present in the selected delivery tray.

The present invention as described above with respect to the four different aspects can be applied to a printer which prints documents based on print data transmitted by a computer. The computer can transmit the print data to the printer via a network. The present invention can also be applied to copy machines or sheet delivery devices which cuts a printed web into printed sheets and delivers the printed sheets.

BRIEF DESCRIPTION OF THE DRAWINGS

The present invention will before apparent from the following detailed description, when taken in conjunction with the accompanying drawings, in which:

FIGS. 3A and 3B are pictorial views to aid in explaining a function of the sheet delivery device of FIG. 2;

FIGS. 4A and 4B are a block diagram of a local area network to which the printer of FIG. 1 is connected and a block diagram of the format of print data sent from a computer to the printer.

DETAILED DESCRIPTION OF THE PREFERRED EMBODIMENTS

Sheet delivery devices embodying the present invention as applied to a printer will be described hereinafter with reference to the accompanying drawings. It should be noted that the sheet delivery device of the present invention can be applied to copy machines or sheet delivery devices which cut a printed web into printed sheets and deliver the printed sheets.

Figure 1:
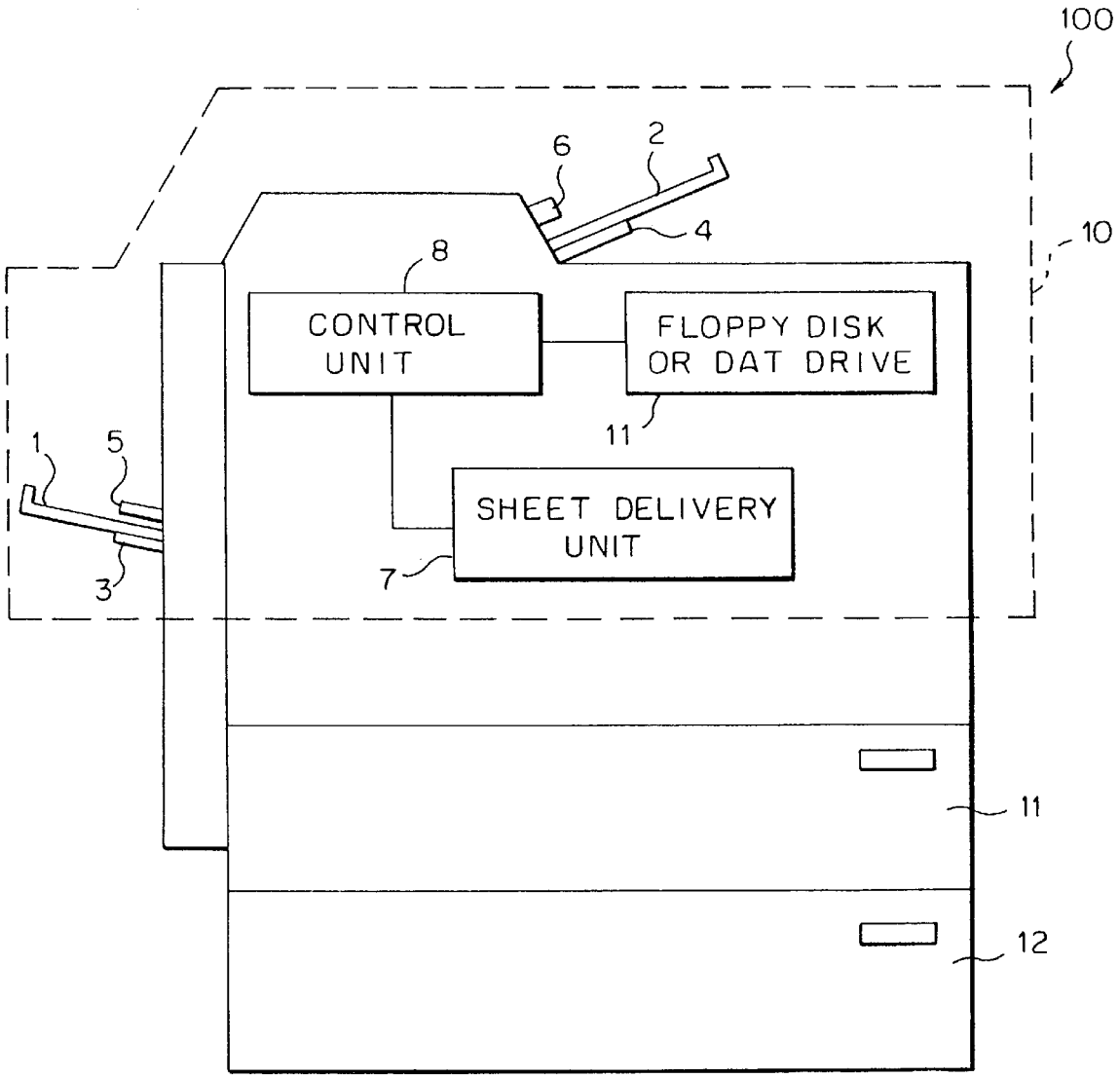
FIG. 1 is a front view of a printer provided with a sheet delivery device in a preferred embodiment according to the present invention.

Referring to FIG. 1, a printer 100 provided with a sheet delivery device 10, in a preferred embodiment according to the present invention, is connected to a computer, not shown, by a communication cable to print out data given thereto by the computer. The sheet delivery device 10 includes a control unit 8 which controls operation of the printer, a sheet delivery unit 7 connected to the control unit 8, for delivering sheets to delivery trays and a floppy disk or digital audio tape (DAT) drive 11, connected to the control unit 8, for use in installing a computer program into the control unit 8.

The printer 100 has two sheet feed trays 11 and 12 containing for example sheets of different sheet sizes, respectively. A sheet feed device, not shown, feeds sheets from either the sheet feed tray 11 or the sheet feed tray 12. A printing mechanism, not shown, prints data on the sheets fed thereto and delivers the printed sheets to the sheet delivery device 10.

Figure 2:
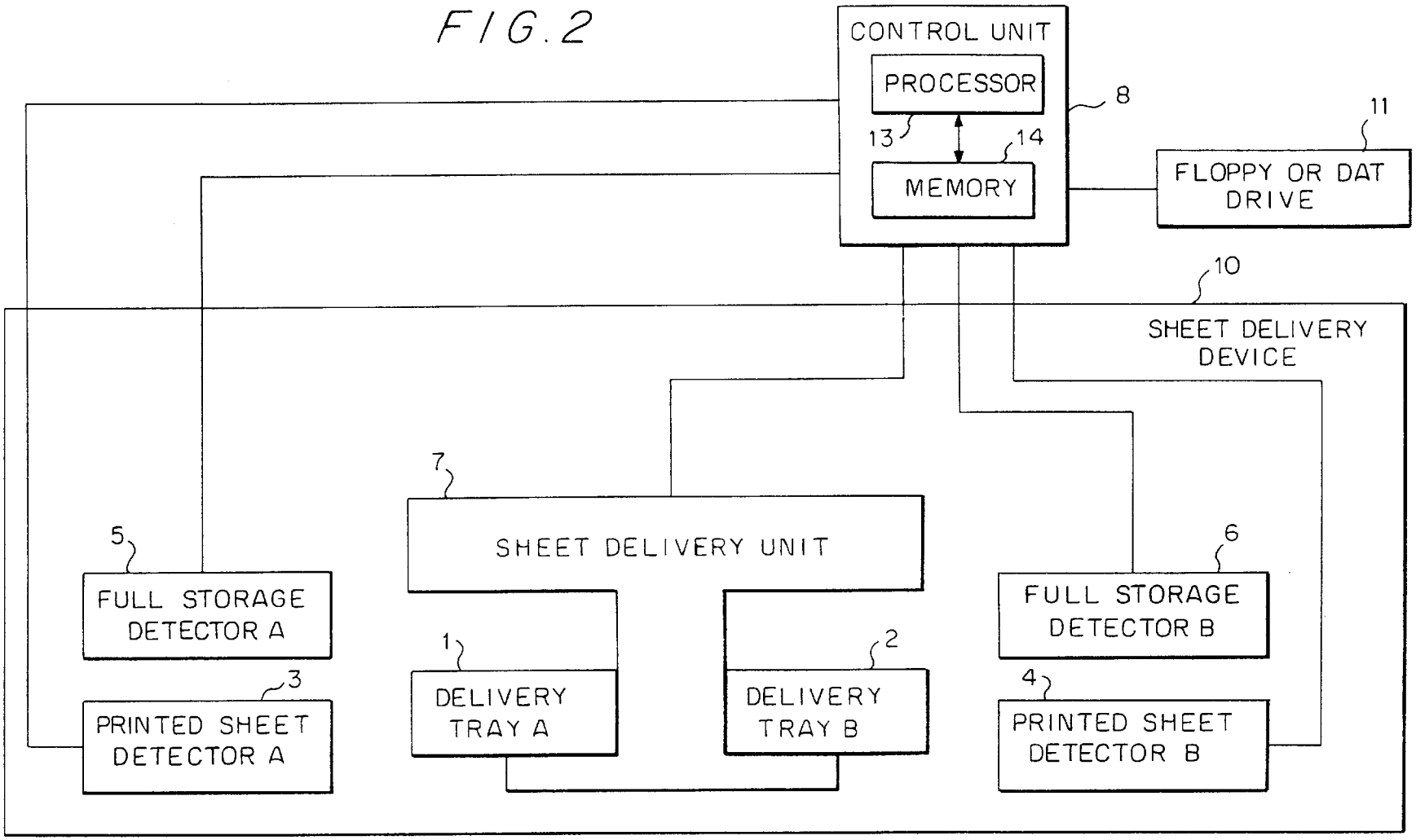
FIG. 2 is block diagram of a sheet delivery device embodying the present invention incorporated into a printer.

The sheet delivery device 10 as illustrated in more detail in FIG. 2 further includes two delivery trays, i.e., a delivery tray A 1 and a delivery tray B 2, two printed sheet detectors, i.e., a printed sheet detector A 3 and a printed sheet detector B 4, and two full storage detectors, i.e., a full storage detector A 5 and a full storage detector B 6. The delivery tray A 1 and the delivery tray B 2 are movable in a direction perpendicular to the paper.

The printed sheet detector A 3 detects the presence of printed sheets in the delivery tray A 1. Each of the printed sheet detector A 3 and the printed sheet detector B 4 may be, for example, an optical sensor which includes a light emitting device which emits light toward a printed sheet stored in the delivery tray A 1, such as an LED, and a light receiving device which receives light reflected from the printed sheet, such as a phototransistor.

The full storage detector A 5 detects the presence of a predetermined number of printed sheets in the delivery tray A 1, i.e., a full storage state of the delivery tray A 1. Each of the full storage detector A 5 and the full storage detector B 6 may be, for example, a mechanical limit switch disposed so as to be closed by a stack of the predetermined number of printed sheets contained in the delivery tray A 1 in the full storage state.

Referring to FIG. 2 illustrating the details of the sheet delivery device 10, the sheet delivery device 10 as described above includes the sheet delivery unit 7 and the control unit 8. The sheet delivery unit 7 and the control unit 8 serve as delivery means for delivering printed sheets to a selected one of the delivery trays. When residual printed sheets exist in the selected delivery tray A 1 or B 2, the sheet delivery unit 7 and the control unit 8 deliver printed sheets to the selected delivery tray A 1 or B 2 in such a manner such that the printed sheets can be discriminated from the residual printed sheets previously stored in the selected delivery tray A 1 or B 2. The control unit 8 selects the delivery tray A 1 or B 2. The control unit 8 selects the delivery tray A 1 when the delivery tray B 2 is in a full storage state, and vice versa.

As illustrated in FIG. 2 the control unit 8 includes a processor 13 and memory 14. At an initialization step S500A the processor 13 referred to below in FIG. 5 controls operation of the floppy disk or DAT drive 11 such that a computer program stored on a floppy disk or DAT is read by the processor 13 and stored in the memory 14. Thereafter, the processor 13 executes the computer program stored in the memory thereby performing the control operations of the printer 100.

FIGS. 3A and 3B illustrate a mechanism included in the sheet delivery unit 7 and associated with the delivery tray A 1. A mechanism associated with the delivery tray B 2 is the same as the mechanism associated with the delivery tray A 1 and hence the description thereof will be omitted. Suppose that the delivery tray A 1 is selected and some residual printed sheets exist in the delivery tray A 1 as shown in FIG. 3A. Then, the sheet delivery unit 7 delivers printed sheets to the delivery tray A 1 after shifting the delivery tray A 1 by a delivery tray shifting mechanism a predetermined distance as shown in FIG. 3B. Consequently, a stack of the printed sheets is dislocated from a position corresponding to a stack of the residual printed sheets, so that the printed sheets can easily be discriminated from the residual printed sheets.

A color paper inserting mechanism may be provided for inserting a colored paper sheet colored in a vivid red or yellow between the stack of residual printed sheets and the stack of printed sheets for discrimination instead of the delivery tray shifting mechanism. Further the edges of the printed sheets of different lots may be colored in different colors, respectively. Also the exit of the sheet delivery unit 7 may be shifted instead of shifting the delivery tray A 1.

Figure 5:
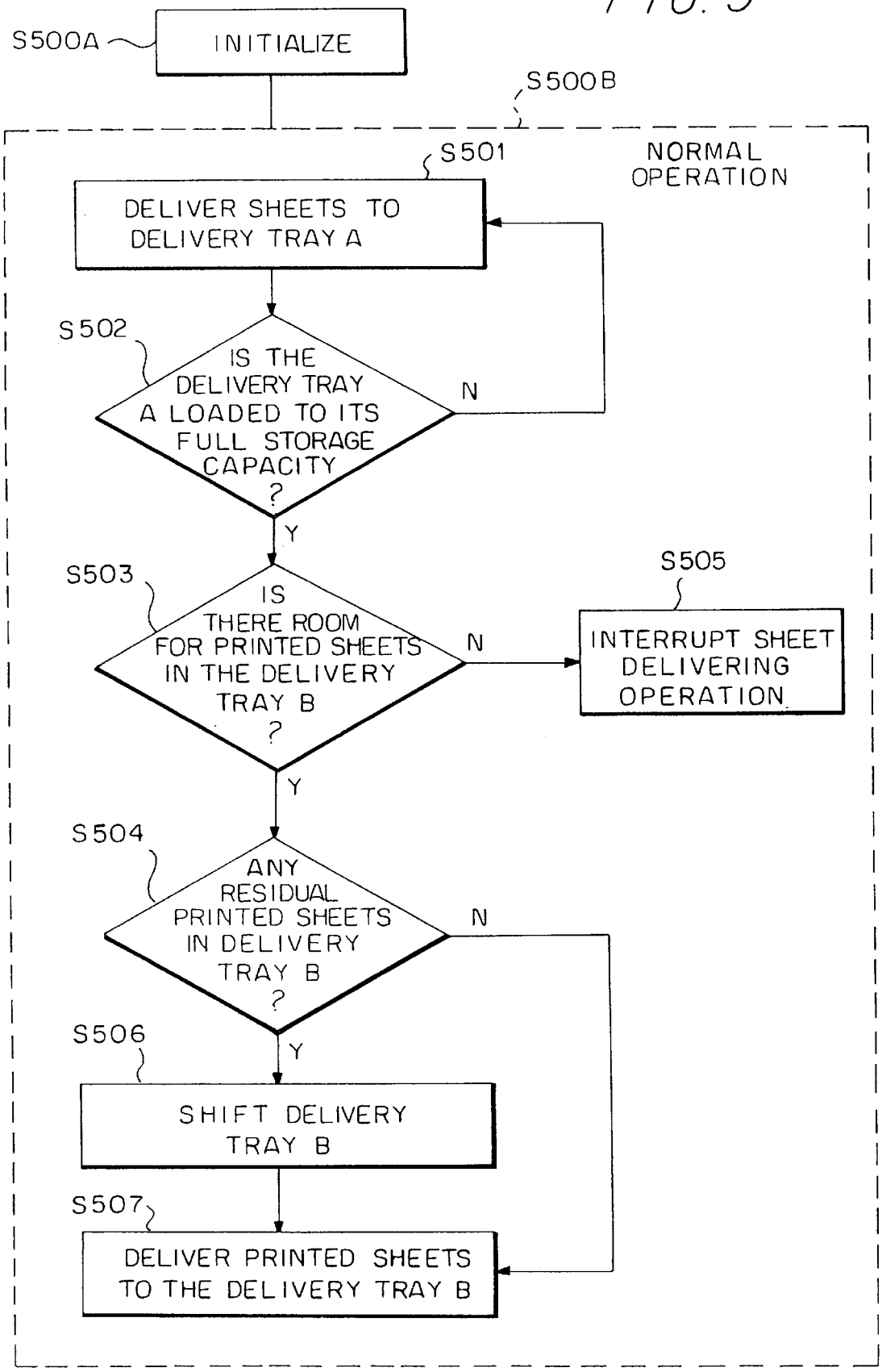
FIG. 5 is a flow chart of operations of the sheet delivery device of FIG. 2.

The operation of the sheet delivery device 10 will be described with reference to FIGS. 2 and 5. Referring to FIG. 5, the control unit 8 after the initialization step S500A as described above implements a normal operation step S500B.

During normal operation the control unit 8 selects the delivery tray A 1 in step S501. Printed sheets then are delivered to the delivery tray A 1. In step S502, the control unit 8 checks the output signal of the full storage detector A 5 every time a printed sheet is delivered to the delivery tray A 1 to see whether or not the delivery tray A is loaded to its full storage capacity. The control unit 8 gives an instruction to deliver the next printed sheet to the delivery tray A 1 to the sheet delivery unit 7 when the delivery tray A 1 has not fully been loaded.

The control unit 8 changes from the delivery tray A 1 to the delivery tray B 2 when the delivery unit A 1 is fully loaded and, consequently, the sheet delivery unit 7 changes from the delivery tray A 1 to the delivery tray B 2. Then, the control unit 8 decides whether or not the delivery tray B 2 has room to receive further printed sheets in step S503. More specifically, the control unit 8 checks the output signal of the full storage detector B 6 to see whether or not the delivery tray B 2 is loaded to its full storage capacity. Step S504 is executed if the delivery tray B 2 is not fully loaded, or step S505 is executed to interrupt the sheet delivering operation if the delivery tray B 2 is loaded to its full storage capacity, i.e., if both the delivery trays A 1 and B 2 are loaded to their full storage capacities. Thus, printed sheets are delivered to the delivery trays A 1 and B 2 until the same are loaded to their full storage capacities.

In step S504, the control unit 8 checks the output signal of the printed sheet detector B 4 to see whether or not any residual printed sheets remain in the delivery tray B 2. The control unit 8 makes the delivery tray shifting mechanism shift the delivery tray B 2 as shown in FIGS. 3B in step S506 if there are some residual printed sheets in the delivery tray B 2, and then makes the sheet delivery unit 7 deliver printed sheets in step S507. The delivery tray B 2 is not shifted when there is no residual printed sheet in the delivery tray B 2. Steps S501 to S507 are repeated to change the destination of printed sheets from the delivery tray A 1 to the delivery tray B 2.

Although not shown in FIG. 5 for the sake of simplicity, step S506 is executed to shift the delivery tray A 1, insert colored paper, select paper for printing from a lot having different colored edges or shift the exit of the sheet delivery unit 7 if there exist some residual printed sheets in the delivery tray A 1 before the first printed sheet is delivered to the delivery tray A 1 in step S501.

The operation of the sheet delivery device 10 may be embodied in a computer program stored on a floppy disk, DAT or CD that is installed in the control unit 8 via the floppy disk or DAT drive 11. The computer program rather then being provided by a storage medium such as a floppy disk or DAT may be distributed to the control unit from a storage medium by a server via a network.

The printer 100 provided with the sheet delivery device 10 may be connected to a LAN (local area network) as shown in FIG. 4. Referring to FIG. 4, work station 200 and 300 and a personal computer 400 are connected to the LAN. The work station 200 has functions of a print server to control the printer 100. The work station 200 is connected to the printer 100 by a communication cable 9, such as an SCSI (small computer system interface). Print data, having a format as illustrated in FIG. 4B including document data and control data, provided by the workstation 300 and the personal computer 400 is transferred through the LAN to the work station 200 to the printer 100, and then the printer 100 prints out the print data. The control data included in the print data provides control instructions for controlling operation of the printer. For example, the control data can provide instructions indicating which sheet feed tray to be selected.

Although the sheet delivery device of the present invention has been described as applied to a printer, the present invention is applicable to a sheet delivery device for copying machines and to a sheet delivery device which cuts a printed web into printed sheets and delivers the printed sheets.

The sheet delivery device may be provided with three or more delivery trays, which are used in turn when the previously selected delivery tray is loaded to its full storage capacity.

According to the present invention, printed sheets delivered into the delivery tray containing residual printed sheets can easily be discriminated from the residual printed sheets, and the sheet delivery operation can be carried out at a high throughput because the delivery trays can be loaded with printed sheets to their full storage capacities.

While the present invention has been described in detail and pictorially in the accompanying drawings it is not limited to such details since many changes and modifications recognizable to those of ordinary skill in the art may be made to the invention without departing from the spirit and the scope thereof.

We claim:

1. A sheet delivery device comprising:

a plurality of delivery trays;

a delivery apparatus which delivers sheets to a selected delivery tray among the plurality of delivery trays; and a selector which selects a delivery tray to which sheets are to be delivered among the plurality of delivery trays;

wherein said delivery apparatus includes discrimination apparatus which discriminates sheets so that the delivered sheets are discriminated from residual sheets when residual sheets are present in the selected delivery tray.

2. A sheet delivery device according to claim 1, further comprising:

a sheet quantity detector which detects whether a predetermined quantity of sheets is contained in the selected delivery tray, wherein the selector selects a delivery tray other than the delivery tray containing the predetermined quantity of sheets detected by said sheet quantity detector; and a sheet detector which detects the presence of residual sheets in the delivery tray other than the delivery tray containing the predetermined quantity of sheets.

3. A sheet delivery device according to claim 1, further comprising:

a sheet detector which detects the presence of residual sheets in the selected delivery tray.

4. A sheet delivery device according to claim 1, further comprising:

a full delivery tray detector which detects whether the selected delivery tray is full;

wherein said selector selects one of the other delivery trays when the selected delivery tray is detected as being full by the full delivery tray detector; and a sheet detector which detects the presence of residual sheets in the other delivery tray.

5. A sheet delivery device according to claim 1, wherein said delivered sheets are discriminated from the residual sheets by shifting the position at which said delivered sheets are delivered.

6. A sheet delivery device according to claim 1, wherein the delivered sheets are discriminated from the residual sheets by delivering a colored sheet such that the colored sheet is positioned between the delivered sheets and the residual sheets.

7. A sheet delivery device according to claim 2, wherein said delivered sheets are discriminated from the residual sheets by shifting the position at which said delivered sheets are delivered.

8. A sheet delivery device according to claim 2, wherein the delivered sheets are discriminated from the residual sheets by delivering a colored sheet such that the colored sheet is positioned between the delivered sheets and the residual sheets.

9. A sheet delivery device according to claim 4, wherein said delivered sheets are discriminated from the residual sheets by shifting the position at which said delivered sheets are delivered.

10. A sheet delivery device according to claim 4, wherein the delivered sheets are discriminated from the residual sheets by delivering a colored sheet such that the colored sheet is positioned between the delivered sheets and the residual sheets.

11. A sheet delivery device according to claim 1 further comprising:

a control unit which controls operation of said delivery apparatus and said selector.

12. A sheet deliver device according to claim 11, further comprising:

a floppy disk drive, connected to said control unit, for use in reading a computer program from a storage medium into said control unit.

13. A sheet delivery device according to claim 12, wherein said control unit comprises:

a processor for executing a computer program; and memory for storing said computer program being executed by said processor and read from said storage medium.

14. A printer for executing a print instruction from a host computer comprising:

a print processor which executes a print instruction from a host computer;

a sheet delivery apparatus which delivers printed sheets to a tray external of said printer; and a sensor which detects presence of residual sheets in said tray;

wherein said sheet delivery apparatus includes discrimination apparatus which shifts a delivery position of a printed sheet so that the delivered sheets are discriminated from residual sheets when said sensor detects the presence of residual sheets in said tray.

15. A method, in a sheet delivery device having a plurality of delivery trays, of delivering printed sheets to one of the delivery trays, comprising the steps of:

selecting a delivery tray to which sheets are to be delivered among the plurality of delivery trays; and delivering sheets to the selected delivery tray among the plurality of delivery trays;

wherein said delivery step comprises the step of:

discriminating sheets so that the delivered sheets are discriminated from residual sheets when residual sheets are present in the selected delivery tray.

16. A method according to claim 15, further comprising the steps of:

detecting whether a predetermined quantity of sheets is contained in the selected delivery tray;

selecting a delivery tray other than the delivery tray containing the predetermined quantity of sheets; and detecting the presence of residual sheets in the delivery tray other than the delivery tray containing the predetermined quantity of sheets.

17. A method according to claim 15, further comprising the steps of:

detecting the presence of residual sheets in the selected delivery tray.

18. A method according to claim 15, further comprising the steps of:

detecting whether the selected delivery tray is full;

selecting one of the other delivery trays when the selected delivery tray is detected as being full; and detecting the presence of residual sheets in the other delivery tray.

19. A method according to claim 15, wherein said delivered sheets are discriminated from the residual sheets by shifting the position at which said delivered sheets are delivered.

20. A method according to claim 15, wherein the delivered sheets are discriminated from the residual sheets by delivering a colored sheet such that the colored sheet is positioned between the delivered sheets and the residual sheets.

21. A method according to claim 16, wherein said delivered sheets are discriminated from the residual sheets by shifting the position at which said delivered sheets are delivered.

22. A method according to claim 16, wherein the delivered sheets are discriminated from the residual sheets by delivering a colored sheet such that the colored sheet is positioned between the delivered sheets and the residual sheets.

23. A method according to claim 18, wherein said delivered sheets are discriminated from the residual sheets by shifting the position at which said delivered sheets are delivered.

24. A method according to claim 18, wherein the delivered sheets are discriminated from the residual sheets by delivering a colored sheet such that the colored sheet is positioned between the delivered sheets and the residual sheets.

25. A method according to claim 15, further comprising the step of:

controlling, by a control unit, operation of said delivery apparatus and said selector.

26. A method according to claim 25, wherein a floppy disk drive, is connected to said control unit, for use in reading a computer program from a storage medium into said control unit.

27. A method according to claim 26, wherein said control unit comprises:

a processor for executing a computer program; and memory for storing said computer program being executed by said processor and read from said storage medium.

28. A method in a printer for executing a print instruction from a host computer, comprising the steps of:

executing a print instruction from a host computer;

delivering printed sheets to a tray external of said printer;

detecting presence of residual sheets in said tray; and discriminating sheets by shifting a delivery position of a printed sheet so that the delivered sheets are discriminated from residual sheets when residual sheets are present in said tray.

29. A computer program for causing a sheet delivery device having a plurality of delivery trays to deliver printed sheets to one of the delivery trays, said computer program being stored on a storage medium and when executed causes said sheet delivery device to perform the steps of:

selecting a delivery tray to which sheets are to be delivered among the plurality of delivery trays; and delivering sheets to the selected delivery tray among the plurality of delivery trays;

wherein said delivery step comprises the step of:

discriminating sheets so that the delivered sheets are discriminated from residual sheets when residual sheets are present in the selected delivery tray.

30. A computer program according to claim 29, further causing the sheet delivery device when executed to perform the steps of:

detecting whether a predetermined quantity of sheets is contained in the selected delivery tray;

selecting a delivery tray other than the delivery tray containing the predetermined quantity of sheets; and detecting the presence of residual sheets in the delivery tray other than the delivery tray containing the predetermined quantity of sheets.

31. A computer program according to claim 29, further causing the sheet delivery device when executed to perform the steps of:

detecting the presence of residual sheets in the selected delivery tray.

32. A computer program according to claim 29, further causing the sheet delivery device when executed to perform the steps of:

detecting whether the selected delivery tray is full;

selecting one of the other delivery trays when the selected delivery tray is detected as being full; and detecting the presence of residual sheets in the other delivery tray.

33. A computer program according to claim 29, wherein said delivered sheets are discriminated from the residual sheets by shifting the position at which said delivered sheets are delivered.

34. A computer program according to claim 29, wherein the delivered sheets are discriminated from the residual sheets by delivering a colored sheet such that the colored sheet is positioned between the delivered sheets and the residual sheets.

35. A computer program according to claim 30, wherein said delivered sheets are discriminated from the residual sheets by shifting the position at which said delivered sheets are delivered.

36. A computer program according to claim 30, wherein the delivered sheets are discriminated from the residual sheets by delivering a colored sheet such that the colored sheet is positioned between the delivered sheets and the residual sheets.

37. A computer program according to claim 32, wherein said delivered sheets are discriminated from the residual sheets by shifting the position at which said delivered sheets are delivered.

38. A computer program according to claim 32, wherein the delivered sheets are discriminated from the residual sheets by delivering a colored sheet such that the colored sheet is positioned between the delivered sheets and the residual sheets.

39. A computer program according to claim 29, further causing the sheet delivery device when executed to perform the step of:

controlling, by a control unit, operation of said delivery apparatus and said selector.

40. A computer program according to claim 39, wherein a floppy disk drive, is connected to said control unit, for use in reading a computer program from a storage medium into said control unit.

41. A computer program according to claim 40, wherein said control unit comprises:

a processor for executing a computer program; and memory for storing said computer program being executed by said processor and read from said storage medium.

42. A computer program according to claim 29, wherein said storage medium is provided by a server which distributes said computer program to said sheet delivery device via a network.

43. A computer program for causing a printer to execute a print instruction from a host computer, said computer program being stored on a storage medium and when executed causes said printer to perform the steps of:

executing a print instruction from a host computer;

delivering printed sheets to a tray external of said printer;

detecting presence of residual sheets in said tray; and discriminating sheets by shifting a delivery position of a printed sheet so that the delivered sheets are discriminated from residual sheets when residual sheets are present in said tray.

44. A computer program according to claim 43, wherein said storage medium is provided by a server which distributes said computer program to said printer via a network.

* * * * *